US008353145B2

(12) United States Patent
Zanini et al.

(10) Patent No.: US 8,353,145 B2
(45) Date of Patent: Jan. 15, 2013

(54) CAPPING MACHINE

(75) Inventors: Gianpietro Zanini, Montanara di Curtatone (IT); Marco Baroni, Barbasso di Roncoferraro (IT)

(73) Assignee: Azionaria Construzioni Macchine Automatiche A.C.M.A. S.p.A. (IT)

( * ) Notice: Subject to any disclaimer, the term of this patent is extended or adjusted under 35 U.S.C. 154(b) by 396 days.

(21) Appl. No.: 12/671,142

(22) PCT Filed: Aug. 1, 2008

(86) PCT No.: PCT/IB2008/002008

§ 371 (c)(1),
(2), (4) Date: Jan. 28, 2010

(87) PCT Pub. No.: WO2009/016489

PCT Pub. Date: Feb. 5, 2009

(65) Prior Publication Data

US 2010/0192514 A1 Aug. 5, 2010

(30) Foreign Application Priority Data

Aug. 2, 2007 (IT) ..... BO2007A0547

(51) Int. Cl.
*B67B 3/20* (2006.01)
*B67B 3/22* (2006.01)
*B67B 3/28* (2006.01)

(52) U.S. Cl. ..... 53/302; 53/317; 53/331.5; 53/368

(58) Field of Classification Search ..... 53/67, 75, 53/76, 95, 272, 276, 302, 308, 331.5, 571, 53/317, 368; 141/95; *B67B 3/10, 3/20, 3/22, B67B 3/28*

See application file for complete search history.

(56) References Cited

U.S. PATENT DOCUMENTS

| | | | | | |
|---|---|---|---|---|---|
| 1,748,960 | A | * | 3/1930 | Risser | 53/308 |
| 1,789,857 | A | * | 1/1931 | Babbitt et al. | 53/302 |
| 1,835,336 | A | * | 12/1931 | Risser | 53/302 |
| 1,860,954 | A | * | 5/1932 | Risser | 53/302 |
| 2,106,365 | A | * | 1/1938 | Tiano | 53/317 |
| 2,359,932 | A | | 10/1944 | Newey | |
| 3,242,632 | A | * | 3/1966 | Dimond | 53/67 |
| 3,309,838 | A | | 3/1967 | Wilhere | |

(Continued)

OTHER PUBLICATIONS

Written Opinion and Search Report for PCT/IB2008/002008, mailed Jan. 21, 2009, 9 pages.

*Primary Examiner* — Stephen F Gerrity
(74) *Attorney, Agent, or Firm* — Timothy J. Klima; Shuttleworth & Ingersoll, PLC

(57) ABSTRACT

A capping machine (1) of carousel design comprises a centre shaft (2) turning on a fixed base frame (3) about a vertical axis of rotation (Y), a set of capping units (4) encircling and revolving as one with the shaft (2) about the axis of rotation (Y), and a cylindrical cam (5) interposed between the shaft (2) and the capping units (4), by which the single units (4) are caused to move toward and away from the fixed base frame (3). During operation, the cam (5) is held in at least one predetermined fixed position relative to the base frame (3) by a single supporting element (6) anchored to the base frame (3), concealed internally of the rotating shaft (2) and connected to the cam (5), which represents a departure from the conventional method of supporting the cam on two or more columns located externally of the carousel structure and exposed to view.

8 Claims, 3 Drawing Sheets

U.S. PATENT DOCUMENTS 3,323,280 A * 6/1967 Rausch ..... 53/571
3,630,242 A * 12/1971 Schieser et al. ..... 141/95
3,707,822 A 1/1973 Van Der Meer
5,584,161 A * 12/1996 Zanini et al. ..... 53/317
6,115,992 A * 9/2000 Bankuty et al. ..... 53/331.5
6,804,929 B2 * 10/2004 Kemnitz ..... 53/75
2006/0272284 A1 * 12/2006 Galimberti et al. ..... 53/75

* cited by examiner

CAPPING MACHINE

CROSS-REFERENCE TO RELATED APPLICATIONS

This application is the National Phase of International Application PCT/IB2008/002008 filed Aug. 1, 2008 which designated the U.S. and that International Application was published under PCT Article 21(2) in English.

This application claims priority to Italian Patent Application No. BO2007A000547 filed Aug. 2, 2007, and PCT Application No. PCT/IB2008/002008 filed Aug. 1, 2008, which applications are incorporated by reference herein.

TECHNICAL FIELD

The present invention relates to a capping machine, in particular for applying fluid-tight closures to containers such as bottles and similar receptacles.

The present invention finds application to advantage in the art field of carousel type machines for capping containers fashioned with a neck and designed to hold a variety of substances, such as liquid food products, mineral lubricating oils, detergents, powders and the like.

BACKGROUND ART

Carousel bottling and packaging systems of conventional design comprise a bed presenting a plurality of bays serving to accommodate respective carousel machine units on which containers are processed, and in particular sterilized, filled with a selected product, then closed with a cap. The bed also houses devices for transferring the containers from one carousel to the next, as well as infeed and outfeed devices by way of which the containers enter and exit the train of carousels.

In carousel type machines, containers filled with a given product are transferred to a capping machine by which a cap or top is applied to the neck of the container, providing a closure.

In particular, carousel type capping machines comprise a revolving plate centred on a substantially vertical axis of rotation and carrying a plurality of peripheral pedestals on which to stand the containers. The containers are directed onto the plate at an infeed station, and released from the plate at an outfeed station separated by a given angular distance from the infeed station. Each container is closed with a cap as it advances, generally along a circular path, between the infeed station and the outfeed station.

For this purpose, capping machines are equipped with a plurality of capping units, each incorporating a relative capping head, positioned vertically above the plurality of pedestals accommodating the containers and revolving about the same axis of rotation as the plate.

In particular, during the rotation of the plate, each capping unit advances while remaining vertically aligned above a container standing on a respective pedestal, and descends simultaneously to the point at which the capping head makes contact with the neck of the container. At this point, a cap or top, offered loosely at first to the neck of the container, will be secured by the capping head. The cap can be screwed or snapped onto the neck, or fitted by a combination of both these actions, depending on the style of cap.

To ensure that the capping units can rotate together with the containers occupying the pedestals, the units are arranged radially about a vertical shaft to which the plate presenting the pedestals is also keyed, so that the single pedestals are arranged likewise radially about the shaft.

The position of the capping units is locked angularly (though not axially) to that of the vertical shaft, so that when the shaft is set in rotation, both the capping units uppermost and the pedestals below will revolve permanently in vertical alignment one with another.

Also, in order that the capping units can be lowered onto the respective containers during the rotation of the carousel, each unit is furnished with one or more following members engaging in a channel that functions as the active profile of a cylindrical cam. The cam is located concentrically between the rotating vertical shaft and the capping units arranged radially about the shaft. The cylindrical cam does not rotate but remains stationary, in other words permanently occupying the same position, whatever the angular position of the vertical shaft and the capping units.

Consequently, as the capping units revolve around the cylindrical cam, they can also be displaced in a vertical direction by the interaction of the following members with the cam profile.

In capping machines typical of the prior art, to guarantee that the cylindrical cam located between the rotating vertical shaft and the capping units will not rotate but remain stationary, the structure includes two vertical columns anchored to the floor and rising parallel to the vertical shaft. The cylindrical cam is made fast to the two columns, so that the columns serve in practice both to support and to keep the cam in a predetermined position as the capping carousel rotates.

Moreover, given that these capping machines must be able to handle different types or styles of containers, depending on the product being packaged any one time (mineral oils, milk, fruit juices, washing powders), the operating distance between the capping units and the pedestals on which the containers are placed must be adjustable in order to suit the height of the container currently in use.

To this end, the capping units are mounted slidably to the rotating vertical shaft, and the cylindrical cam controlling the vertical movement of each capping unit toward and away from the neck of the relative container is mounted slidably to the fixed columns.

In particular, the capping units are raised and lowered relative to the vertical shaft by means of a lead screw coupled to a lead nut anchored rotatably to the capping units (and therefore to the rotating vertical shaft). The lead screw is driven by an electric motor and housed internally of the rotating vertical shaft. To ensure that the lead nut, driven in rotation by the vertical shaft, cannot turn on the lead screw during the operation of the capping machine (causing the capping units to be raised or lowered, with adverse consequences), the lead screw is coupled to the electric motor by way of a pneumatic clutch and thus freewheelable, with the result that the entire lead nut and lead screw assembly can rotate as one with the vertical shaft, free of any other constraint, as long as the capping machine is in operation.

The cylindrical cam is coupled to the columns by way of upright members rigidly associated with the cam and slidably associated, by way of sleeves, with the columns.

Thus, the entire superstructure consisting of the capping units and the cylindrical cam can be moved toward or away from the revolving plate.

Capping machines of the prior art described briefly above are affected by certain drawbacks.

Firstly, such machines are particularly expensive, given that the vertical columns supporting the cylindrical cam must necessarily be made of structural steel and encased in stainless steel machine-turned to exact design tolerances in order to guarantee a faultless coupling between the selfsame columns and the aforementioned sleeves, avoiding any clearances that could induce even minimal oscillations of the cylindrical cam and jeopardize the smooth operation of the machine.

Conversely, if there is zero clearance in the fit between the sleeves and the columns, the sleeves will bind when sliding on the columns during the operation of adjusting the vertical distance between the capping units and the pedestals.

Moreover, the use of particularly high cost materials (stainless steel) for the construction of the columns is dictated by the need for thorough sanitization of these same columns when switching from one kind of process to another (from bottling lubricating oils to bottling milk, by way of example).

Similarly, the inclusion of the pneumatic clutch not only increases the costs of construction but also seriously complicates the design of the machine as a whole. Also, in the event that the clutch should fail to uncouple the lead screw completely from the electric motor, the operation of the capping machine will need to be suspended at frequent intervals in order to adjust the height of the capping units above the pedestals.

Moreover, with the inclusion of the vertical columns supporting the cylindrical cam, the integration of the capping machine into a train with other carousels is rendered especially problematical.

DISCLOSURE OF THE INVENTION

The object of the present invention, accordingly, is to provide a capping machine that will be unaffected by the drawbacks mentioned above.

One object of the invention, in particular, is to provide a capping machine of which the costs incurred in construction and operation are relatively modest.

Another object of the present invention is to provide a capping machine that will be easily incorporated into a train of carousels together with other machine units.

The stated objects and others besides are realized in a capping machine of which the characterizing features are recited in one or more of the appended claims.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

With reference to the accompanying drawings, numeral 1 denotes a capping machine according to the present invention, in its entirety.

Figure 2:
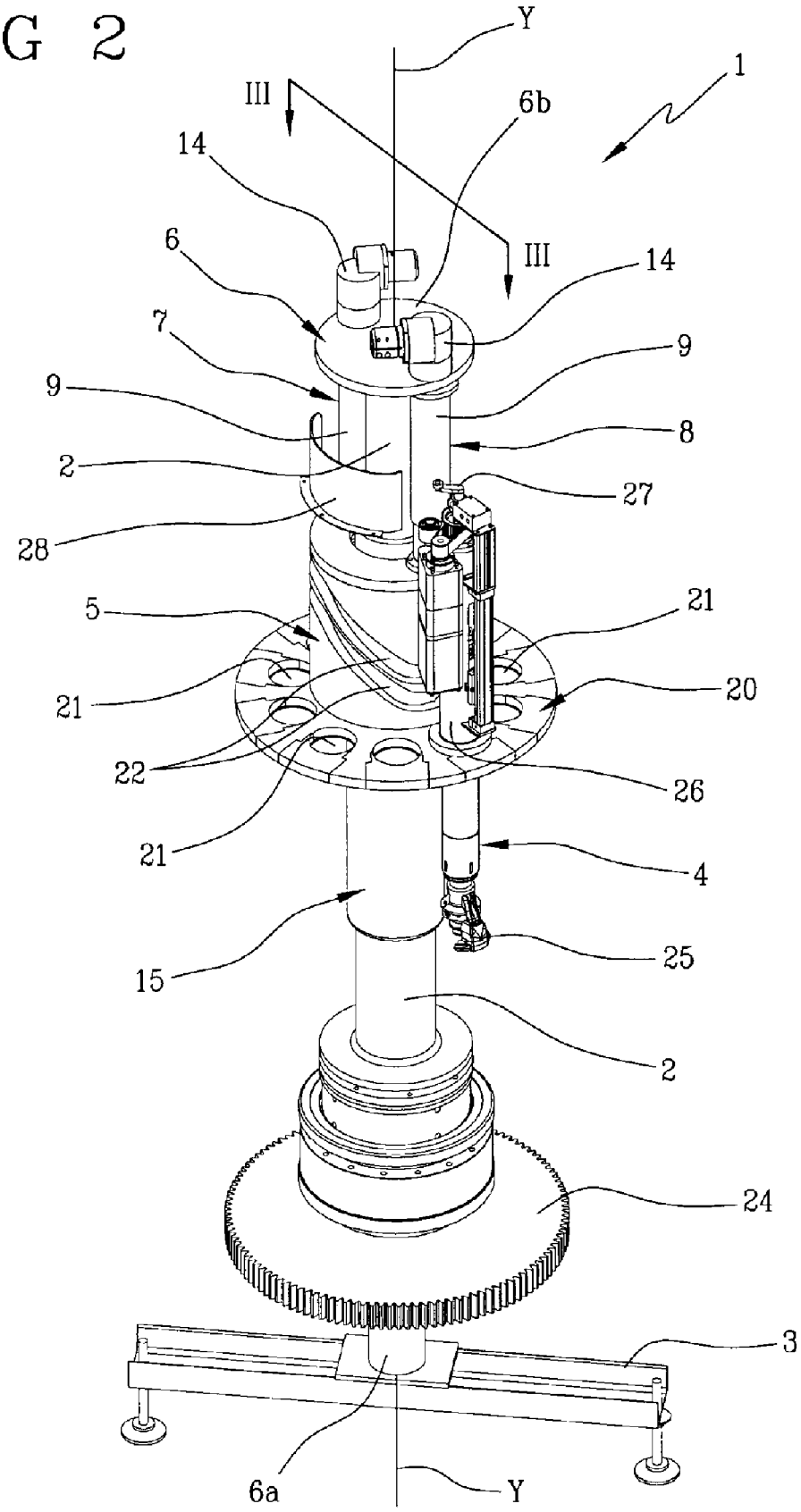
FIG. 2 shows the machine of FIG. 1, viewed in perspective and with certain parts omitted better to reveal others.
Figure 3:
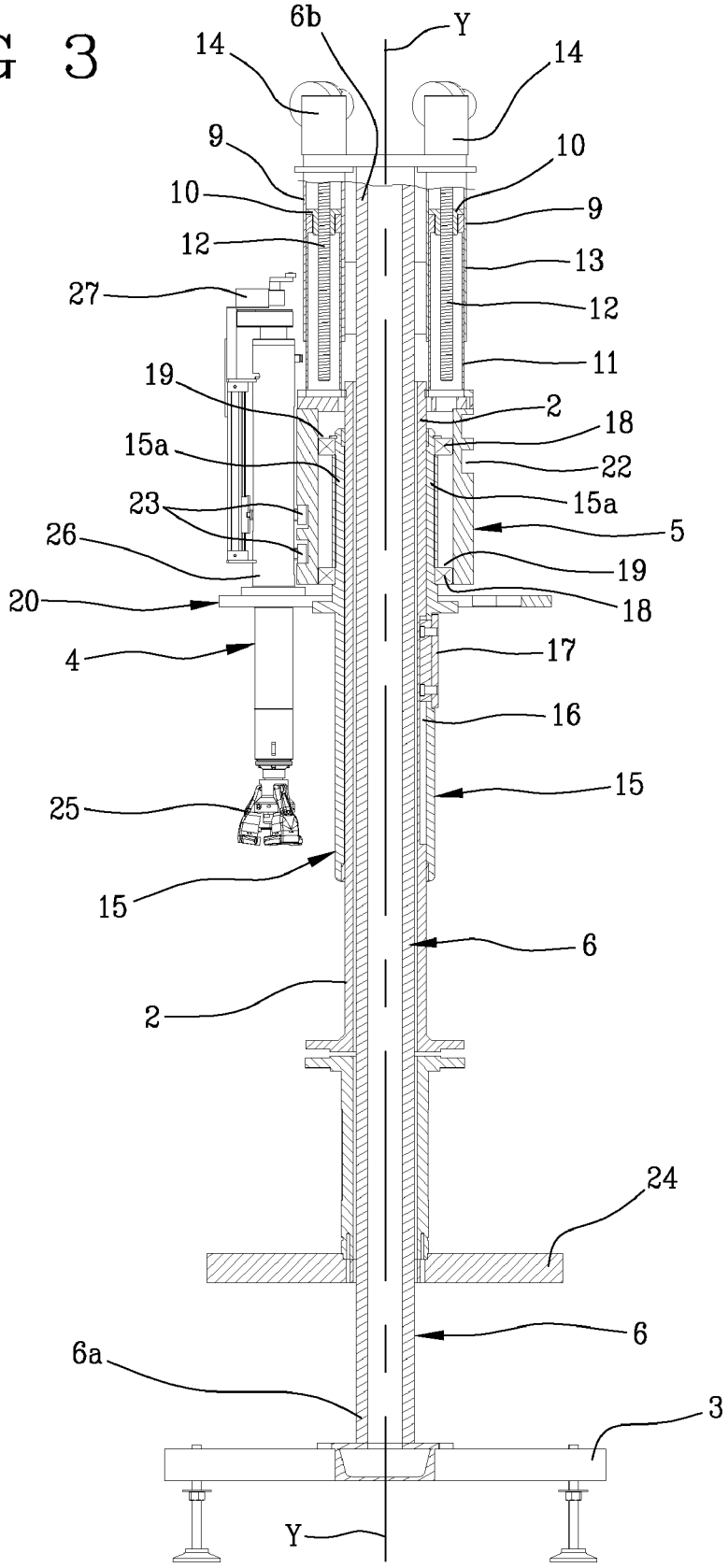
FIG. 3 shows the machine of FIG. 2 in a section on III-III, with certain parts represented pictorially better to illustrate the parts effectively illustrated in section.

The machine 1, which is of carousel design, comprises a shaft 2 rising from a fixed base frame 3 and rotatable about a substantially vertical axis Y, also a plurality of capping units 4 (one only of which is illustrated in FIGS. 2 and 3) ordered radially about the rotating shaft 2.

The capping units 4 are constrained to revolve as one with the shaft 2 when set in rotation, while capable of linear motion relative to the shaft 2 along axes parallel to the axis of rotation Y, above the containers (not illustrated) being capped on the machine.

Translational movement of the capping units 4 toward and away from the base frame 3 is induced by a cylindrical cam 5 coaxially ensheathing the shaft 2, interposed between the selfsame shaft and the capping units 4 and associated rigidly with the base frame 3. The cylindrical cam 5 engages the capping units 4 actively and in such a way that when the shaft 2 is set in rotation, the units 4 are moved toward and away from the base frame 3, guided by the cam 5.

To retain the cylindrical cam 5 in a fixed position relative to the base frame 3, the machine 1 comprises a supporting element 6 anchored to the base frame 3, housed internally of the rotating shaft 2 and connected to the cylindrical cam 5 (see FIG. 3).

To advantage, the cam 5 is connected to the supporting element 6 in such a way that it can be positioned selectively at a plurality of operating distances from the base frame 3.

Accordingly, the cam 5 can be set closer to or farther away from the base frame 3 depending on the type of container to be capped, or to all intents and purposes, as dictated by the height of the container.

In effect, the machine comprises a plate of conventional embodiment (not illustrated) fashioned with pedestals providing stands for the containers, which is rigidly associated and rotatable as one with the shaft 2 at a fixed height above the base frame 3.

The positioning of the plate (not illustrated) permanently at a fixed distance from the base frame 3, irrespective of the type or style of container being capped, is dictated by the need to guarantee correct alignment of the carousel capping machine 1 with other carousel machine units (not illustrated), such as those by which the containers are first sterilized and then filled with a selected product, combining to make up a full bottling and packaging line.

In particular, as illustrated in FIG. 3, the supporting element 6 that carries the cylindrical cam 5 is tubular, presenting a first end **6*a* anchored to the base frame 3 and a second end 6*b* projecting from the rotating shaft 2. The cam 5 is connected to the supporting element 6 by way of coupling means 7 (FIGS. 2 and 3) interposed between the second end 6*a* of the supporting element and a top portion of the cam 5**.

As shown in FIG. 3, the coupling means 7 in question comprise means 8 by which to adjust the distance between the second end **6*b* of the supporting element 6 and the cam 5, allowing a translational movement of the cam 5 relative to the shaft 2 and the base frame 3**.

In the preferred embodiment illustrated, adjustment means 8 take the form of a telescopic mechanism 9 operating between the cam 5 and the supporting element 6, and more exactly the second end **6*b*** of the element.

The telescopic mechanism 9 comprises a lead nut 10 rigidly associated with the cam 5 by way of a first sleeve 11, to which the nut is attached directly, and a lead screw 12 rigidly associated with the supporting element 6. The lead nut 10 is guided along the lead screw 12 by a second sleeve 13, rigidly associated with the supporting element 6, along which the aforementioned first sleeve 11 is also slidable telescopically (FIG. 3).

The lead screw 12 is driven in rotation by a motor 14, preferably hydraulic and/or pneumatic, positioned at the second end **6*b* of the supporting element 6**.

It will be seen that the machine 1 comprises two telescopic mechanisms 9, positioned on either side of the second end **6*b* presented by the supporting element 6** and spaced 180° apart.

Activating the motors 14, therefore, the cam 5 will be raised or lowered relative to the base frame 3, and with it the associated capping units 4.

To this end, the machine 1 comprises a sleeve 15 ensheathing and constrained to rotate together with the vertical shaft 2. The constraint consists in a groove 16 presented by the shaft 2, extending in a direction substantially parallel to the axis of rotation Y, and a projection 17 presented by the sleeve 15 ensheathing the shaft 2.

The length dimension of the projection 17, as measured substantially parallel to the axis of rotation Y, will be less than that of the groove measured in the same direction, so that the projection 17 is afforded room for axial movement within the groove 16 (FIG. 3).

Moreover, the width dimensions of the groove 16 and of the projection 17, transverse to the direction of mutual sliding motion, are all but identical, so as to disallow any relative angular movement between the two components 16 and 17 and guarantee the necessary constraint between sleeve 15 and shaft 2.

The sleeve 15 is rigidly associated with the cam 5, and thus made to translate as one with the cam 5 when displaced in order to accommodate a different size of container.

The sleeve 15 and the cam 5 are permanently associated via a portion 15*a* of the sleeve 15, inserted between the shaft 2 and the cam 5 (FIG. 3).

The aforementioned portion 15*a* of the sleeve 15 is interfaced by way of rolling bearings 18 with the internal surface of the cam 5 directed toward the shaft 2. The bearings 18 are housed in respective seats 19 such as will disallow translational movement of the cam 5 relative to the sleeve 15, while on the other hand allowing the sleeve 15 freedom of rotation relative to the cam 5 (FIG. 3).

The carousel further comprises a disc 20 (FIGS. 2 and 3) presenting a plurality of holes 21, rigidly associated with the sleeve 15, rotatable as one with the shaft 2 and translatable as one with the sleeve 15, hence also with the cam 5.

The disc 20 projects radially from the sleeve 15, and each of the aforementioned holes 21 slidably accommodates a single capping unit 4 (see FIG. 2 in which one only of the capping units 4 is indicated, occupying a respective hole 21).

Accordingly, the capping units 4 are constrained to rotate as one with the shaft 2 while also capable of linear motion, relative to the shaft, along directions parallel to the axis of rotation Y.

With the arrangement described above, more exactly, the capping units 4 are able to translate toward and away from the base frame 3 as one with the cam 5 when switching to a different size or style of container; similarly, the capping units can be raised and lowered relative to the base frame 3 during normal operation, when the shaft 2 is set in rotation.

During a size changeover, in effect, the entire assembly including the cam 5, sleeve 15, disc 20 and capping units will be raised or lowered relative to the base frame 3 (through the agency of the telescopic mechanisms 9), whereas during normal operation, only the capping units 4 will be raised and lowered relative to the base frame 3, through the agency of the cam 5.

To this end, as illustrated in FIG. 2, a preferred embodiment of the cam 5 will be fashioned with two parallel guide channels 22 extending around the outer surface of the cam 5 and of depth not exceeding the full thickness of the cylindrical wall.

Each capping unit 4 comprises two following members 23 engaging freely in the guide channels 22 of the cam 5 (FIG. 3).

Thus, the capping units 4 are carried in rotation by the disc 20, and invested simultaneously with motion by the fixed cam 5, relative to the rotating shaft 2, in a direction parallel to the axis of rotation Y.

The vertical shaft 2 is driven in rotation by a gear 24 keyed to the selfsame shaft 2 and housed in the base frame 3. The gear 24 itself will be driven by a suitable motor (not illustrated).

The capping units 4 are equipped with respective capping heads 25 attached to lower end portions of the single units.

The capping heads 25, which might be of any given type and consequently will not be described in detail, are capable of movement relative to the barrel 26 of the capping unit 4, typically for the purpose of twisting a screw cap onto a relative container.

With this function in view, each of the capping units 4 is equipped with a mechanical microswitch 27, located preferably at the top end of the unit 4.

The microswitches 27 are operated by a substantially half-cylindrical striker plate 28 mounted concentrically with the supporting element 6 and rigidly associated with the cam 5.

The plate 28 establishes a path along which the microswitches 27 are activated. As the capping units 4 revolve on the carousel, each microswitch 27 in turn will be engaged and operated by the plate 28, which remains fixed in relation to the shaft 2, according to the angular position of the capping unit 4 (which corresponds to a given angular position of a container about to be capped).

Figure 1:
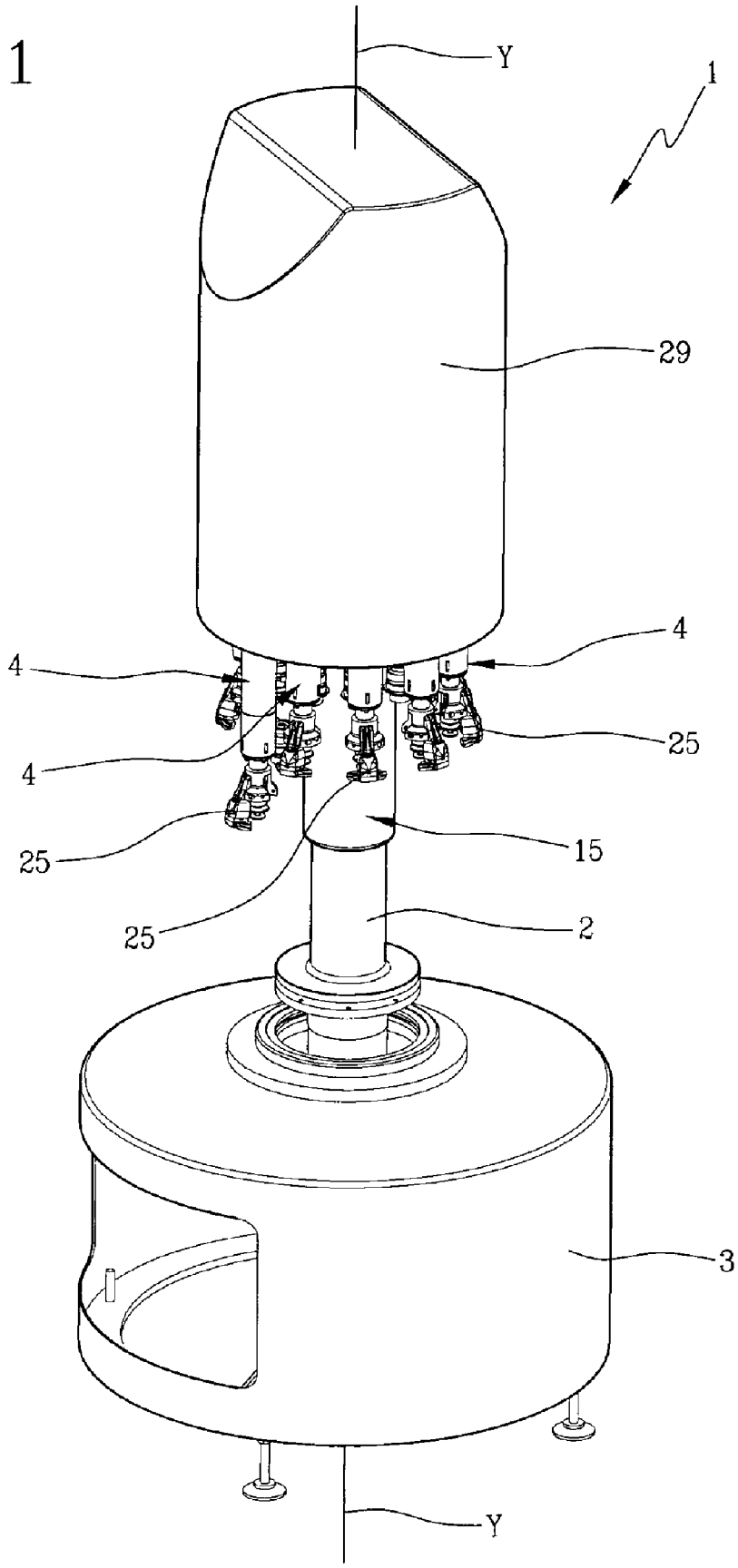
FIG. 1 shows a capping machine according to the present invention, viewed in perspective.

The machine 1 further comprises a casing 29 that surrounds and covers the capping units 4 at least in part and encloses the topmost part of the carousel (FIG. 1). The casing 29 is anchored to the second end 6*b* of the supporting element 6 and therefore fixed in relation to the base frame 3.

The objects stated at the outset are realized in accordance with the present invention.

Thanks to the adoption of a supporting element 6 housed internally of the rotating shaft 2 in the capping machine 1 disclosed, it becomes possible to dispense with the columns used to support the cam in prior art solutions, and thus significantly reduce the construction costs involved.

With a supporting element 6 as described and illustrated, moreover, the machine can be integrated without difficulty into a train of carousels since there are no parts on the capping machine presenting an obstruction to the frames or beds of other carousel units (as in the case of the cam support columns in machines of the prior art).

Likewise advantageously, the casing 29 protects the entire capping machine, and in particular its moving parts, from undesirable contaminants (dust, dirt, and spatter from products with which the containers are filled), thereby reducing the time that the machine remains idle for servicing operations.

The coupling means, and in particular the telescopic mechanisms 9, allow a swift and simple reconfiguration of the machine 1 when changing from one size or style of container to another.

Also, with the cam supported by an element housed internally of the rotating shaft, there is no need for this same element to be fashioned from high grade materials, given that it is shielded from the direct action of external agents (unlike the exposed columns typical of the prior art), and hidden from view.

Finally, the capping machine according to the invention is unaffected by the tendency of height-adjustment mechanisms to bind or jam when switching to a different size or style of container, as occurs in machines of the prior art.

What is claimed is:

1. A capping machine comprising:

a shaft turning on a fixed base frame about a substantially vertical axis of rotation;

a plurality of capping units arranged radially about the shaft and constrained to revolve as one with the shaft about the axis of rotation;

a substantially cylindrical cam interposed between the shaft and the plurality of capping units, by which the capping units are caused to move toward and away from the fixed base frame;

a supporting element anchored to the base frame, housed internally of the rotating shaft and connected to the cam, by which the cam is retained in at least one predetermined fixed position relative to the base frame;

wherein the supporting element is tubular and comprises a first end anchored to the base frame and a second end opposite to the first end, extending be and a top end of the rotating shaft, and the cam is connected to the supporting element by a coupling mechanism operating between the second end of the supporting element and the cam; and wherein the coupling mechanism comprises an adjustment mechanism for altering a distance between the second end of the supporting element and the cam, in order to translate the cam along a direction substantially parallel to the axis of rotation.

2. A machine as in claim 1, wherein the connection between the cam and the supporting element is such as will allow the movement of the cam through a plurality of positions, all of which fixed relative to the base frame and located along a direction substantially parallel to the axis of rotation.

3. A machine as in claim 2, comprising a sleeve ensheathing the rotating shaft and constraining the plurality of capping units to revolve as one with the rotating shaft, wherein the sleeve is constrained in slidable association with the cam and translatable thus along the direction substantially parallel to the axis of rotation together with the cam.

4. A machine as in claim 1, wherein the adjustment mechanism comprises at least one telescopic mechanism operating between the second end of the supporting element and the cam.

5. A machine as in claim 4, wherein the telescopic mechanism comprises a lead nut rigidly associated with the cam or with the supporting element, engaged by a lead screw rigidly associated with the supporting element or with the cam and set in rotation by a hydraulic or pneumatic drive mechanism.

6. A machine as in claim 1, wherein each capping unit comprises a capping head and extends in a direction substantially parallel to the axis of rotation, and comprises at least one following member engaging at least one guide channel of the cam.

7. A machine as in claim 1, comprising a substantially half-cylindrical striker plate disposed concentrically with the supporting element and rigidly associated with the cam, establishing a path along which to trip microswitches associated each with a respective capping unit to activate the relative capping head, wherein the activation of the microswitches is a function of an angular position assumed by each capping unit.

8. A capping machine as in claim 1, comprising a gear wheel encircling and rigidly associated with the rotating shaft, by which the shaft is driven in rotation.

* * * * *